US006096418A

United States Patent [19]

Sato et al.

[11] Patent Number: 6,096,418

[45] Date of Patent: Aug. 1, 2000

[54] SHEET FOR INK-JET RECORDING

[75] Inventors: Takaya Sato; Tsutomu Uehara, both of Tokyo, Japan

[73] Assignee: Nisshinbo Industries, Inc., Tokyo, Japan

[21] Appl. No.: 09/064,388

[22] Filed: Apr. 22, 1998

[30] Foreign Application Priority Data

Apr. 28, 1997 [JP] Japan ..... 9-110984

[51] Int. Cl.[7] ..... B41M 5/00

[52] U.S. Cl. ..... 428/323; 428/195; 428/532

[58] Field of Search ..... 428/195, 532, 428/323

[56] References Cited

U.S. PATENT DOCUMENTS 5,141,599 8/1992 Jahn .

FOREIGN PATENT DOCUMENTS

| | | |
|---|---|---|
| 0 445327 | 9/1991 | European Pat. Off. . |
| 0 480 362 | 4/1992 | European Pat. Off. . |
| 0 524 635 | 1/1993 | European Pat. Off. . |
| 0 673 779 | 9/1995 | European Pat. Off. . |
| 0 728 593 | 8/1996 | European Pat. Off. . |
| WO 96/08377 | 3/1996 | WIPO . |

*Primary Examiner*—Pamela R. Schwartz
*Attorney, Agent, or Firm*—Jones & Askew, LLP

[57] ABSTRACT

To provide a sheet for ink-jet recording having a low ink-spreading property and an excellent sheet-feeding property, a sheet for ink-jet recording which comprises a base material taking the form of sheet and an ink receiving layer which is laminated onto at least one surface of the base material and contains a binder and fine porous polysaccharide particles is produced. Further, the above-mentioned sheet for ink-jet recording wherein the fine porous polysaccharide particles are exposed on the surface of the ink receiving layer to form unevenness thereon is produced.

3 Claims, 1 Drawing Sheet

SHEET FOR INK-JET RECORDING

TECHNICAL FIELD

The present invention relates to a sheet for recording letters, images, or the like, and more particularly, to a sheet for ink-jet recording which is suitably used in an ink-jet recording system.

BACKGROUND ART

As a system for recording letters, images, or the like on a sheet ("recording letters, images, or the like" on a sheet is hereinafter sometimes referred to as "printing"), there is an ink-jet recording system in which minute liquid droplets of ink are made to fly to be adhered to a sheet. It is popularly used as a printing system in a printer connected to a computer terminal and the like.

However, while the ink-jet recording system is excellent in speed, definition, flexibility in a recording pattern and the like, it also has some drawbacks. More specifically, if the surface of the recording sheet is poor in ink absorption, ink which adheres onto the sheet spreads to blur the recording image. If the surface of the sheet is poor in water resistance, in case the recorded image is touched with wet cloth or a wet finger, the ink is dissolved in the water to stain the sheet. The ink-jet recording system also has a drawback that ink tends to spread in continuous printing.

Accordingly, as means for solving the drawbacks mentioned above, a sheet in which an ink receiving layer consisting of organic high molecular particles and adhesive is provided and space necessary for the ink receiving layer to absorb ink is formed by adjusting the size of the organic high molecular particles or porous silica particles are contained in the ink receiving layer to improve ink absorption, is known.

However, the conventional sheet for ink-jet recording mentioned in the above is not sufficient in ink absorption and water resistance on the surface, and there are more and more demands for clearer images.

Further, as printing speed of a printer improves, there are more and more demands for excellence in feeding of a sheet for ink-jet recording so as to prevent a plurality of sheets from adhering to each other and from being fed all together.

SUMMARY OF THE INVENTION

An object of the present invention is to provide a sheet for ink-jet recording which has a low ink-spreading property and an excellent sheet-feeding property.

As a result of having studied earnestly to achieve the above object, it has been found that a sheet for ink-jet recording, which exhibits an unexpectedly excellent printing property and an excellent sheet-feeding property, can be obtained by adding fine polysaccharide particles having a fine porous structure in an ink receiving layer resulting in the completion of the present invention.

Namely, the present invention is a sheet for ink-jet recording which comprises a base material taking the form of sheet and an ink receiving layer laminated onto at least one surface of the base material, wherein the ink receiving layer contains a binder and fine porous polysaccharide particles. As to the sheet for ink-jet recording of the present invention, the above-described fine porous polysaccharide particles are generally exposed on the surface of ink receiving layer to form unevenness thereon. Preferably, the mean particle size of the above-described fine porous polysaccharide particles is 0.1 to 20 $\mu$m, and more preferably is 0.1 to 5 $\mu$m.

The sheet for ink-jet recording of the present invention is excellent in the ink absorption and water resistance and spreads ink hardly so that letters, images and the like which are recorded on the sheet are very clear. The sheet for ink-jet recording of the present invention is also excellent in the sheet-feeding property.

DETAILED DESCRIPTION OF THE INVENTION

The present invention is described in detail as follows.

The sheet for ink-jet recording of the present invention is a sheet for ink-jet recording which comprises a base material taking the form of sheet and an ink receiving layer laminated onto at least one surface of the base material, wherein the ink receiving layer contains a binder and fine porous polysaccharide particles. In the sheet for ink-jet recording of the present invention, the ink receiving layer containing the fine porous polysaccharide particles is excellent in the ink absorption and the like, and spreads ink hardly.

Figure 1:
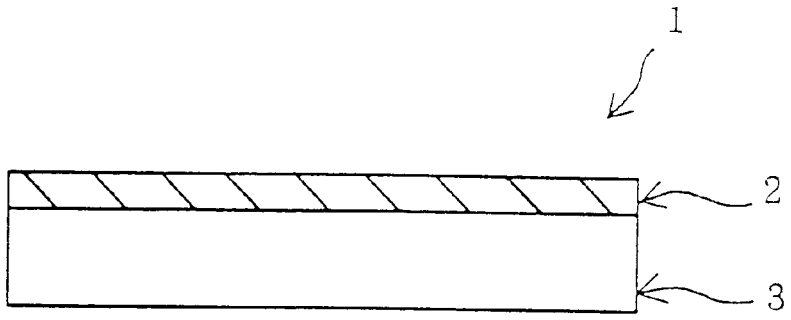
FIG. 1 shows a sectional view of a sheet for ink-jet recording of the present invention.

As FIG. 1 shows, the sheet for ink-jet recording 1 of the present invention comprises a base material 3 taking the form of sheet and an ink receiving layer 2 laminated onto at least one surface of the base material. As the base material, many kinds of transparent or opaque, or colored media which is in the form of sheet, and is used for recording letters, images and so on by ink or the like may be used preferably. Specific examples thereof may include paper comprising mainly vegetable fibers; resin film comprising mainly resins such as polyolefin, for example, polyethylene, polypropylene and the like, polyvinyl chloride, polystyrene, polyvinyl alcohol, polyester, nylon, polycarbonate, cellulose acetate, and the like; synthetic paper made of the above-described resin film and other materials, and the like.

The ink receiving layer is the main portion, in which ink is adhered to record letters and the like, and is laminated onto at least one surface of the base material. Therefore, it may be laminated onto both surfaces of the base material. The thickness of the ink receiving layer is preferably 1 to 30 $\mu$m, and more preferably 1 to 20 $\mu$m. This range of thickness is preferable for the ink absorption of the ink receiving layer and gives no trouble for handling as the recording sheet.

The ink receiving layer of the sheet for ink-jet recording of the present invention contains a binder and fine porous polysaccharide particles.

As the binder, varied kinds of high molecular materials may be used preferably (High molecular materials used as binder are called hereinafter as "binder polymers"), as long as it can form the ink receiving layer together with the fine porous polysaccharide particles and adhere the fine porous polysaccharide particles to the ink receiving layer. Examples of the binder polymers preferably include a natural, semi-synthetic or synthetic water soluble high molecular material and the like, and more preferably as the natural water soluble high molecular material, pullulan, dextran and the like; as the semi-synthetic water soluble high molecular material, carboxyethyl cellulose, dextrin, methyl cellulose, ethyl cellulose, hydroxyehyl cellulose, hydroxypropyl cellulose, hydroxypropylmethyl cellulose and the like; and as the synthetic water soluble high molecular material, polyvinyl alcohol, polyacrylamide, polyacrylic acid, polyvinylpyrrolidone, polyethyleneimine, polyglycidol and the like. One or more kind(s) of binder polymers may be contained in the ink receiving layer. A common cross-linking agent may be added to improve the water resistance of binder polymer itself in the ink receiving layer.

The fine porous polysaccharide particles to be used in the present invention are hydrophilic and have fine porous structures. Accordingly, an ink may be absorbed rapidly into pores of fine porous polysaccharide particles contained in the ink receiving layer at the time of the printing by the ink-jet recording system, so that the surface of the ink receiving layer, i.e. the surface of the sheet for ink-jet recording may be dried quickly and may spread ink little. Further, the fine porous polysaccharide particles themselves take in the dye component of ink at the time of the printing by the ink-jet recording system so that the ink receiving layer may hardly spread ink and be excellent in the water resistance, even if moisture is adhered to the ink receiving layer after the printing.

The fine porous polysaccharide particles to be used in the present invention are preferably obtained by cross-linking water soluble polysaccharide or derivatives thereof to make it water insoluble. There are included as water soluble polysaccharide or derivatives thereof, mannan, pululan, alginic acid, dextrin, glucomannan, starch, guar gum, cellulose derivatives and the like. To make these polysaccharides or their derivatives insoluble, they may be cross-linked by means of polyvalent metal ions, common cross-linking agents containing glycidyl group, or a cross-linking agent containing formalin. Among the fine porous polysaccharide particles obtained by non-solubilizing the above polysaccharides or the like, the particles obtained by non-solubilizing alginic acid with cross-linking are preferably used in the present invention, because they are dimensionally stable on absorbing water to maintain the shape of the ink receiving layer and the adhesional state to the base material. For instance, the polyvalent metal salts of alginic acid particles are exampled preferably. One or more kind(s) of the fine porous polysaccharide particles may be included in the ink receiving layer. The mean particle size of the fine porous polysaccharide particles is preferably 0.1 to 20 $\mu$m, more preferably 0.1 to 5 $\mu$m. Within this range of particle size, the surface area of fine porous polysaccharide particles in the ink receiving layer is kept sufficiently to provide a good absorption of ink and a good sheet-feeding property, which is explained hereinafter.

Alginic acid is one of polysaccharides and a dehydrated polymer of mannuronic acid and its isomer glucuronic acid ($C_5H_9O_5$.COOH). Alginic acid can be obtained generally by treating the sodium carbonate extract of dried seaweeds with hydrochloric acid. The polyvalent metal salts of alginic acid to be used in the present invention have the structure in which alginic acid is cross-linked by polyvalent metal ion, and are insoluble in water unlike alginic acid. The polyvalent metal salts of alginic acid is preferably used as particles in the present invention, whereas the polyvalent metal salts may be occasionally obtained as a gel when merely alginic acid is cross-linked by polyvalent metal ion.

The particles of the polyvalent metal salts of alginic acid may be obtained by, for example, preparing particles of an aqueous solution of a monovalent metal salt from alginic acid and an alkali metal such as sodium, potassium and the like by means of the spray drying process, the emulsion process or the like and then dipping the same in an aqueous solution containing a polyvalent metal ion. Alternatively, an aqueous solution of the above-described monovalent metal salt of alginic acid or the solution treated with acid may be stirred in an aqueous solution containing a polyvalent metal ion and the resulting insoluble material is separated, dried and pulverized to yield the particles of the polyvalent metal salts of alginic acid.

Examples of the polyvalent metal salts of alginic acid include salts from alginic acid and a metal such as calcium, zinc, beryllium, magnesium, barium, cadmium, mercury, strontium, radium, lead, copper, iron, aluminum, cobalt, nickel, chromium, manganese and the like. Among these salts, calcium alginate, copper alginate, zinc alginate, magnesium alginate and barium alginate are preferable, and calcium alginate and copper alginate are more preferable. One or more kind(s) of the particles of metal salts of alginic acid may be contained in the ink receiving layer as the fine porous polysaccharide particles.

The content of the fine porous polysaccharide particles in the ink receiving layer is preferably 1 to 20 parts by weight, and more preferably 5 to 15 parts by weight referred to 100 parts by weight of the binder. Within the range of the content of the particles in the ink receiving layer, when an ink is adhered to the ink receiving layer, the ink is absorbed rapidly in the ink receiving layer so as to hardly spread ink, and damages such as the separation of the ink receiving layer from the base material due to the reduction of mechanical strength of the ink receiving layer may occur hardly and a good sheet-feeding property may be attained which is explained hereinafter.

Desirably, the fine porous polysaccharide particles are contained homogeneously in the ink receiving layer.

Other than the binder and the fine porous polysaccharide particles as mentioned above, a cross-linking agent for binder, a lubricant, a preservation, a pigment, a dye, a viscosity adjusting agent, an organic or inorganic filler and the like may be occasionally contained in the ink receiving layer.

Figure 2:
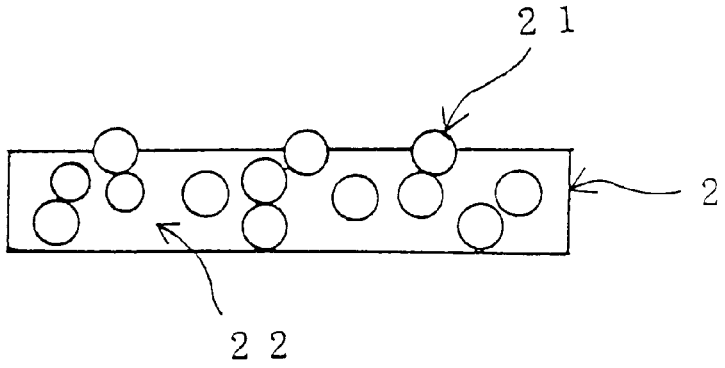
FIG. 2 shows a magnified sectional view of an ink-receiving layer of a sheet for ink-jet recording of the present invention.

The fine porous polysaccharide particles are generally exposed on the surface of the ink receiving layer of the sheet for ink-jet recording of the present invention to form unevenness on the surface of the ink receiving layer. Namely, as FIG. 2 shows, some of the fine porous polysaccharide particles 21 contained with the binder polymers 22 in the ink receiving layer 2 are exposed on the surface of the ink receiving layer to form unevenness thereon with the fine porous polysaccharide particles. Accordingly, in the sheet for ink-jet recording of the present invention, a proper clearance between the sheets can be maintained and a plurality of sheets may be not adhered to each other and not fed at the same time so that the sheet according to the present invention is excellent in the sheet-feeding property. The degree of unevenness can be controlled by adjusting the particles size of the fine porous polysaccharide particles and the content of the fine porous polysaccharide particles in the ink receiving layer. The preferred ranges of the particles size and the content have been previously mentioned respectively.

The sheet for ink-jet recording of the present invention may be produced by laminating the ink receiving layer onto at least one surface of the base material. For example, the binder, the fine porous polysaccharide particles, the cross-linking agent for binder, the lubricant and the like are first blended in an aqueous solvent to yield a dope. The resulting dope is coated onto the surface of the base material by means of the screen-printing method using a bar-coater, a knife-coater or the like, the gravure-printing method, the spraycoating method, dip-coating method or the like, fixed so as not to be deformed and cured at approximately 50 to 150° C. for about from 5 seconds to 20 minutes, whereby the sheet for ink-jet recording of the present invention which has the ink receiving layer containing the binder and the fine porous polysaccharide particles can be produced. When the dope as mentioned above is prepared and coated onto the surface of the base material by means of the bar coater or the like, the fine porous polysaccharide particles may be exposed substantially on the surface of the resulting ink receiving layer after curing to form the unevenness depending on the particle size and the content of the fine porous polysaccharide particles in the ink receiving layer.

The sheet for ink-jet recording of the present invention is excellent in the ink absorption and may be used preferably for the printing by the ink-jet recording system. When the sheet for ink-jet recording of the present invention is used for printing, a common printing method may be adopted. The sheet for ink-jet recording of the present invention may be used not only for the ink-jet recording system but also for other recording systems. In addition, it will be expected that the sheet for ink-jet recording of the present invention can be applied to various kinds of sheet feeding systems due to its excellent sheet-feeding property.

EXAMPLES

The present invention will be described more particularly hereinafter.

Example 1

Preparation of calcium alginate particles

An aqueous solution of sodium alginate, which has been prepared by dissolving 700 kg of sodium alginate obtained from dried seaweeds in ten times quantity of water, was emulsified in 5000 kg of n-hexane as oil phase with 7.7 kg of polyglycerine condensed recinoleic acid ester (trade name: Sunsoft 818H, TAIYO KAGAKU CO., LTD.) by means of homomixer. The resulting emulsion was added to 6000 kg of 20 wt % aqueous solution of calcium chloride to cause the ionic cross-linking, thereby preparing the water-insoluble and spherical particles of calcium alginate. After washing with water and drying them, 490 kg of calcium alginate particles having mean particle size 3 μm were obtained.

Examples 2 to 10 and Comparative Examples 1 to 8

According to the compositions as shown in Table 1, a binder polymer was dissolved in water and a cross-linking agent, a catalyst, an auxiliary agent, and the particles of alginic acid polyvalent metal salt i.e. calcium alginate particles obtained in above Example 1 or copper alginate particles prepared with the same manner as that in Example 1 were further added to yield a dope. Then the dope was coated on a base material sheet which is also shown in Table 1 by means of a bar-coater having a gap of 100 μm, fixed so as not to be deformed and cured at 110° C. for 10 minutes to produce the sheet for ink-jet recording of the present invention (Examples 2 to 10).

Comparative recording sheets (Comparative Examples 1 to 8) were produced with the same procedure as that in Examples 2 to 10 except using the dope having the composition as shown in Table 2.

The components shown in Table 1 and 2 are as follows: polyvinyl alcohol (PVA, mean polymerization degree is 1700, saponification degree is ca. 96%, Wako Pure Chemical Industries, Ltd.), Polyvinyl pyrrolidone k-90 (for cosmetic additive, Wako Pure Chemical Industries, Ltd.) or carboxymethyl cellulose CMC (Wako Pure Chemical Industries, Ltd.) as the binder polymer; Denakol EX 810 (epoxy series cross-linking agent, Nagase Kasei Kogyo Company), Sumitex M-3 (melamine series cross-linking agent, Sumitomo Chemical Company Ltd.), Sumitex 250 conc (urea series cross-linking agent, Sumitomo Chemical Company Ltd.) or Sumitex NS-2 (glyoxal series cross-linking agent, Sumitomo Chemical Company Ltd.) as the cross-linking agent; polyacrylic acid (mean polymerization degree is 2700, 28% aqueous solution, Wako Pure Chemical Industries, Ltd.) as the auxiliary agent; Sumitex ACX (amine series catalyst, Sumitomo Chemical Company Ltd.) as the catalyst; and talc (mean particle size is 10 to 20 μm, Nippon Talc Co.), acrylic resin (mean particle size is 5 to 20 μm, Matsumoto Yushi Company), epoxy resin (mean particle size is 5 to 20 μm, Matsumoto Yushi Company), styrene resin (mean particle size is 5 to 20 μm, Monsant Company) or urethane resin (mean particle size is 10 to 20 μm, Nisshin Boseki Company) as the particles for Comparative Examples.

TABLE 1

| Example No. | Base Material | Binder Polymer | Cross-linking Agent | Auxiliary Agent | Catalyst | Water | Particles |
|---|---|---|---|---|---|---|---|
| Example 2 | PET Film | Polyvinyl Alcohol (5) | Denakol EX810 (5) | Polyacrylic Acid (0.1) | — | (88.9) | Calcium Alginate (1) |
| Example 3 | PET Film | Polyvinyl Alcohol (5) | Denakol EX810 (5) | Polyacrylic Acid (0.1) | — | (84.9) | Calcium Alginate (5) |
| Example 4 | Kent Paper | Polyvinyl Alcohol (5) | Denakol EX810 (5) | Polyacrylic Acid (0.1) | — | (84.9) | Calcium Alginate (5) |
| Example 5 | PET Film | Polyvinyl Pyrrolidone k-90 (5) | Sumitex M-3 (5) | — | Sumitex ACX(0.5) | (88.5) | Calcium Alginate (1) |
| Example 6 | PET Film | Polyvinyl Pyrrolidone k-90 (5) | Sumitex M-3 (5) | Polyacrylic Acid (0.1) | Sumitex ACX(0.5) | (88.4) | Calcium Alginate (1) |
| Example 7 | PET Film | Polyvinyl Pyrrolidone k-90 (5) | Sumitex M-3 (5) | Polyacrylic Acid (0.1) | Sumitex ACX(0.5) | (89.1) | Calcium Alginate(0.3) |
| Example 8 | PET Film | Carboxymethyl Cellulose CMC (1) | Sumitex 250 conc (5) | — | Sumitex ACX(0.5) | (92.5) | Calcium Alginate (1) |
| Example 9 | PET Film | Carboxymethyl Cellulose CMC (1) | Sumitex NS-2 (5) | — | Sumitex ACX(0.5) | (92.5) | Calcium Alginate (1) |

TABLE 1-continued

| Example No. | Base Material | Binder Polymer | Cross-linking Agent | Auxiliary Agent | Catalyst | Water | Particles |
|---|---|---|---|---|---|---|---|
| Example 10 | PET Film | Carboxymethyl Cellulose CMC (1) | Sumitex NS-2 (5) | — | Sumitex ACX(0.5) | (92.5) | Copper Alginate (1) |

*The number in ( ) means part by weight.

TABLE 2

| Comparative Example No. | Base Material | Binder Polymer | Cross-linking Agent | Auxiliary Agent | Catalyst | Water | Particles |
|---|---|---|---|---|---|---|---|
| Comparative Example 1 | PET Film | Polyvinyl Alcohol (5) | Denakol EX810 (5) | Polyacrylic Acid (0.1) | — | (89.9) | — |
| Comparative Example 2 | PET Film | Polyvinyl Alcohol (5) | Denakol EX810 (5) | Polyacrylic Acid (0.1) | — | (88.9) | Tale (1) |
| Comparative Example 3 | Kent Paper | Polyvinyl Alcohol (5) | Denakol EX810 (5) | Polyacrylic Acid (0.1) | — | (84.9) | Talc (5) |
| Comparative Example 4 | PET Film | Polyvinyl Pyrrolidone k-90 (5) | Sumitex M-3 (5) | Polyacrylic Acid (0.1) | Sumitex ACX (0.5) | (88.4) | Tale (1) |
| Comparative Example 5 | PET Film | Polyvinyl Pyrrolidone k-90 (5) | Sumitex M-3 (5) | Polyacrylic Acid (0.1) | Sumitex ACX (0.5) | (88.4) | Acrylic Resin (1) |
| Comparative Example 6 | PET Film | Polyvinyl Pyrrolidone k-90 (5) | Sumitex M-3 (5) | Polyacrylic Acid (0.1) | Sumitex ACX (0.5) | (88.4) | Epoxy Resin (1) |
| Comparative Example 7 | PET Film | Polyvinyl Pyrrolidone k-90 (5) | Sumitex M-3 (5) | Polyacrylic Acid (0.1) | Sumitex ACX (0.5) | (88.4) | Styrene Resin (1) |
| Comparative Example 8 | PET Film | Polyvinyl Pyrrolidone k-90 (5) | Sumitex M-3 (5) | Polyacrylic Acid (0.1) | Sumitex ACX (0.5) | (88.4) | Urethane Resin (1) |

*The number in ( ) means part by weight.

<Ink-jet Recording Test>

The recording sheets of Example 2 to 10 and Comparative Example 1 to 8 were subjected to the color ink-jet recording by using four color inks A, B, C and D shown in Table 3 under the recording condition of 300×300 DPI and image element size of mean diameter 90 $\mu$m of ink droplet and the following test items were evaluated for the recording sheets after recording respectively. The results of evaluation is shown in Table 4.

(1) Water Resistance

A recording sheet after the ink-jet recording was dried for 1 hour in a room and then 0.1 cc of water was dropped by means of a syringe on the sheet and rubbed by a finger to observe the printed condition after the above treating. The results ware evaluated with the following four stages.

4: No change are observed.

3: Some spreads are observed.

2: Apparent spreads are observed.

1: Recorded image has been dissolved in water and disappeared (2) Degree of Spread A recording sheet after the ink-jet recording was dried for 1 hour in a room, then the printed dots on the sheet were observed by means of an optical stereoscopic microscope to measure the magnification degree of the dots to the mean diameter (90 $\mu$m) of ink droplet. The less degree of magnification means the less degree of spread.

(3) Ink Absorption

A recording sheet after the ink-jet recording was recorded again with the inks and then the pouring-out of ink and the clearness of image were evaluated with the following criteria.

3: No ink has been pouring-out and the image is clear.

2: The image is a litter obscure.

1: The image is obscure.

(4) Sheet-Feeding Property

Fifty recording sheets of A4 size of Examples and Comparative Examples were put one upon another, loaded with weights of 50 kg and stood at 40° C. and 80% RH for 12 hours respectively. Then each bundle of sheets was fed by an ink-jet printer having a roller-type paper feeder and the number of times that a plurality of sheets were fed was counted while the fifty sheets were feeding.

(5) Evaluation of Moisture-Dewing on the Sheet

A recording sheet after the ink-jet recording was cooled for 5 hours in a refrigerator (4° C.) and then took out in a room at 25° C. and 60% RH and continuously the surface of recording sheet was observed to evaluate with the following criteria:

3: No change is observed with eyes.

2: The sheet surface is fogged with moisture.

1: Water drops are observed on the sheet surface.

TABLE 3

Inks used for Evaluation

| | Ink Color | Component | Amount of Blending (Part by weight) |
|---|---|---|---|
| A | Yellow ink | C.I. Acid Yellow 23 | 2 |
| | | Diethylenglycol | 30 |
| | | Water | 70 |
| B | Magenta ink | C.I. Acid Yellow 92 | 2 |
| | | Diethylenglycol | 30 |
| | | Water | 70 |
| C | Cyan ink | C.I. Acid Blue 86 | 2 |
| | | Diethylenglycol | 30 |
| | | Water | 70 |

TABLE 3-continued

| | Ink Color | Inks used for Evaluation Component | Amount of Blending (Part by weight) |
|---|---|---|---|
| D | Black ink | C.I. Direct Black 19 | 2 |
| | | Diethylenglycol | 30 |
| | | Water | 70 |

TABLE 4

| Example or Comparative Example No. | Water Resistance | Degree of Spread | Ink Absorption | Sheet-Feeding Property | Evaluation of Moisture-Dewing |
|---|---|---|---|---|---|
| Example 2 | 3 | 2 | 3 | 0 | 3 |
| Example 3 | 4 | 2 | 3 | 0 | 3 |
| Example 4 | 3 | 2 | 3 | 0 | 3 |
| Example 5 | 3 | 2 | 3 | 0 | 3 |
| Example 6 | 4 | 2 | 3 | 0 | 3 |
| Example 7 | 4 | 2 | 3 | 0 | 3 |
| Example 8 | 3 | 2 | 3 | 0 | 3 |
| Example 9 | 3 | 2 | 3 | 0 | 3 |
| Example 10 | 3 | 2 | 3 | 0 | 3 |
| Comparative Example 1 | 1 | 4 | 1 | 8 | 1 |
| Comparative Example 2 | 2 | 3 | 1 | 4 | 1 |
| Comparative Example 3 | 1 | 4 | 1 | 5 | 1 |
| Comparative Example 4 | 2 | 3 | 1 | 4 | 1 |

TABLE 4-continued

| Example or Comparative Example No. | Water Resistance | Degree of Spread | Ink Absorption | Sheet-Feeding Property | Evaluation of Moisture-Dewing |
|---|---|---|---|---|---|
| Comparative Example 5 | 2 | 3 | 1 | 3 | 1 |
| Comparative Example 6 | 1 | 3 | 1 | 4 | 1 |
| Comparative Example 7 | 2 | 3 | 1 | 4 | 1 |
| Comparative Example 8 | 1 | 3 | 1 | 9 | 1 |

What is claimed is:

1. A sheet for ink-jet recording which comprises a base material which is a sheet and an ink receiving layer laminated onto at least one surface of the base material, wherein the ink receiving layer contains a binder and fine porous polysaccharide particles obtained by non-solubilizing alginic acid with cross-linking.

2. A sheet for ink-jet recording as claimed in claim 1, wherein the fine porous polysaccharide particles are exposed on the surface of the ink receiving layer to form unevenness on the surface of the ink receiving layer.

3. A sheet for ink-jet recording as claimed in claim 1 or 2, wherein the mean particle size of the fine porous polysaccharide particles is 0.1 to 20 $\mu$m.

* * * * *